US010818278B2

(12) United States Patent
Liu et al.

(10) Patent No.: US 10,818,278 B2
(45) Date of Patent: Oct. 27, 2020

(54) RESONANCE SIGNAL GENERATING METHOD, RESONANCE SIGNAL GENERATING DEVICE, ELECTRONIC MUSICAL APPARATUS AND NON-TRANSITORY COMPUTER READABLE MEDIUM

(71) Applicant: Yamaha Corporation, Hamamatsu-shi, Shizuoka-ken (JP)

(72) Inventors: Encai Liu, Hamamatsu (JP); Masafumi Nakata, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 16/514,181

(22) Filed: Jul. 17, 2019

(65) Prior Publication Data

US 2019/0341013 A1 Nov. 7, 2019

Related U.S. Application Data

(63) Continuation of application No. PCT/JP2018/000628, filed on Jan. 12, 2018.

(30) Foreign Application Priority Data

Jan. 18, 2017 (JP) ..... 2017-007120

(51) Int. Cl.
*G10H 1/00* (2006.01)
*G10H 1/08* (2006.01)
*G10D 3/10* (2006.01)

(52) U.S. Cl.
CPC ..... *G10H 1/08* (2013.01); *G10D 3/10* (2013.01); *G10H 1/0091* (2013.01);
(Continued)

(58) Field of Classification Search
CPC ..... G10H 2250/521; G10H 2250/515; G10H 1/125; G10H 1/0091; G10H 2210/281;
(Continued)

(56) References Cited

U.S. PATENT DOCUMENTS 5,648,629 A * 7/1997 Kozuki ..... G10H 1/06 84/660
5,777,255 A * 7/1998 Smith, III ..... G10H 5/007 84/661

(Continued)

FOREIGN PATENT DOCUMENTS

JP 63-267999 A 11/1988
JP 2015-143763 A 8/2015
JP 2015-143764 A 8/2015

OTHER PUBLICATIONS

International Search Report (PCT/ISA210) issued in PCT Application No. PCT/JP2018/000628 dated Mar. 27, 2018 with English translation (three pages).

(Continued)

*Primary Examiner* — Marlon T Fletcher
(74) *Attorney, Agent, or Firm* — Crowell & Moring LLP

(57) ABSTRACT

A resonance signal generating method includes generating a first resonance signal of a first pitch circulating through first loop processing by inputting a first excitation signal to the first loop processing including first delay that delays the signal by a time corresponding to the first pitch and first attenuation that attenuates the signal, the first pitch being a pitch having a resonance frequency of a predetermined speaking length of a piano, generating a second resonance signal of a second pitch circulating through second loop processing by inputting a second excitation signal to the second loop processing including second delay that delays the signal by a time corresponding to the second pitch and second attenuation that attenuates the signal, the second (Continued)

pitch not being a pitch having a resonance frequency of any of speaking lengths of the piano or a pitch of a harmonic thereof but being higher than the first pitch, and outputting the first resonance signal circulating through the first loop processing and the second resonance signal circulating through the second loop processing.

20 Claims, 8 Drawing Sheets

(52) U.S. Cl.
CPC . *G10H 2210/271* (2013.01); *G10H 2210/285* (2013.01); *G10H 2250/051* (2013.01); *G10H 2250/061* (2013.01)

(58) Field of Classification Search
CPC ..... G10H 2210/291; G10H 2210/271; G10H 2250/535; G10H 2250/115; G10H 2250/111; G10H 2250/121; G10H 2220/221
See application file for complete search history.

(56) References Cited

U.S. PATENT DOCUMENTS

| | | | | |
|---|---|---|---|---|
| 2012/0247306 | A1* | 10/2012 | Shimizu | G10H 5/007 84/616 |
| 2015/0221296 | A1 | 8/2015 | Nakata | |
| 2015/0228261 | A1 | 8/2015 | Nakata | |
| 2019/0341012 | A1* | 11/2019 | Liu | G10H 1/00 |
| 2019/0341013 | A1* | 11/2019 | Liu | G10H 1/08 |

OTHER PUBLICATIONS

Japanese-language Written Opinion (PCT/ISA/237) issued in PCT Application No. PCT/JP2018/000628 dated Mar. 27, 2018 (three pages).

* cited by examiner 341L, 341R···LEVEL ADJUSTOR
342···ADDER

RESONANCE SIGNAL GENERATING METHOD, RESONANCE SIGNAL GENERATING DEVICE, ELECTRONIC MUSICAL APPARATUS AND NON-TRANSITORY COMPUTER READABLE MEDIUM

BACKGROUND OF THE INVENTION

Field of the Invention

The present invention relates to a resonance signal generating method and a resonance signal generating device for generating a resonance signal simulating resonance of a string based on an input excitation signal, an electronic musical apparatus including the resonance signal generating device, a non-transitory computer readable medium storing a program for allowing a computer to perform the resonance signal generating method.

Description of Related Art

Conventionally, an attempt to electronically reproduce the sound generated by a natural musical instrument has been made by simulation of the behavior of the natural musical instrument.

As the technique in this field, JP 63-267999 A, for example, describes a technique for outputting a sound signal corresponding to a designated name of musical note (example C, D, E, F, G, A, B; Do, Re, Mi, Fa, Sol, La, Si) through a means for applying reverberation effects respectively having resonance peaks at a plurality of frequency positions respectively having the relationship of an integral multiplication with frequencies of pitches corresponding to a plurality of names of musical notes. By using the technique, a reverberation effect simulating a resonance effect caused by a plurality of sound-generating vibrators such as strings of a piano can be added to the sound signal, and the sound signal simulating the sound of the natural musical instrument can be generated.

Further, JP 2015-143763 A and JP 2015-143764 A describe a technique that enables the flexible setting of resonance frequencies by combining a delay time in a delay circuit in which a delay length can be set on a sample basis with an all-pass filter in which the delay length can be set more finely than on a sample basis in a resonance sound generation circuit that generates sound signals indicative of resonance sounds simulating sounds of strings of a piano.

BRIEF SUMMARY OF THE INVENTION

However, with the conventionally known method, a delay amount in loop processing of a resonance sound generating circuit is set such that each pitch (and its harmonics) is enhanced for simulation of a resonance sound generated by a string of the pitch. However, with this method, only the resonance sound generated by a speaking length can be simulated.

On the other hand, in a conventional acoustic piano (hereinafter simply referred to as a "piano,") each string has a so-called front duplex and a so-called rear duplex in addition to a speaking length that is strung to have the resonance frequency of a corresponding pitch (see FIG. 4). Although being shorter than the speaking length, the front and rear duplexes are strung to be vibratable. The front and rear duplexes receive vibration energy of the speaking length or strings around the front and rear duplexes through a frame and a bridge, thereby vibrating accordingly to generate sound.

In particular, when Staccato is played on a piano, reverberation of a high pitch remains even with a damper abutting against a string after a key depression. Vibration of the front and rear duplexes contribute to this reverberation.

However, such reverberation to which the front and rear duplexes contribute cannot be reproduced with the conventional method of producing a resonance sound.

An object of the present invention is to solve such a problem and enable generation of a resonance sound of a string closer an actual piano or its sound signal when a musical performance sound simulating the piano or its sound signal is generated.

In order to achieve the object described above, a resonance signal generating method according to one aspect of the present invention includes generating a first resonance signal of a first pitch circulating through first loop processing by inputting a first excitation signal to the first loop processing including first delay that delays the signal by a time corresponding to the first pitch and first attenuation that attenuates the signal, the first pitch being a pitch having a resonance frequency of a predetermined speaking length of a piano, generating a second resonance signal of a second pitch circulating through second loop processing by inputting a second excitation signal to the second loop processing including second delay that delays the signal by a time corresponding to the second pitch and second attenuation that attenuates the signal, the second pitch not being a pitch having a resonance frequency of any of speaking lengths of the piano or a pitch of a harmonic thereof but being higher than the first pitch, and outputting the first resonance signal circulating through the first loop processing and the second resonance signal circulating through the second loop processing.

In the embodiment, the generating the first resonance signal may include generating the first resonance signal circulating through the first loop processing by adding the signal attenuated by the first attenuation and the input first excitation signal to each other, delaying the added signal by the first delay and attenuating the signal delayed by the first delay by the first attenuation, and the generating the second resonance signal may include generating the second resonance signal circulating through the second loop processing by adding the signal attenuated by the second attenuation and the input second excitation signal to each other, delaying the added signal by the second delay and attenuating the signal delayed by the second delay by the second attenuation.

In the embodiment, the first and second excitation signals may be sound signals that are generated based on a common musical performance operation.

In the embodiment, the resonance signal generating method may further include adding the first and second resonance signals to each other and attenuating the added first and second resonance signals, and inputting the signals acquired by addition and attenuation to the first and second loop processing.

In the embodiment, the generating the first and second resonance signals may include performing a plurality of sets of the first and second loop processing respectively corresponding to a plurality of speaking lengths of the piano, and a second pitch in second loop processing in each set does not have to be a pitch having a resonance frequency of any of speaking lengths of the piano or a pitch of a harmonic thereof.

In the embodiment, the generating the first and second resonance signals may include performing a plurality of sets of the first and second loop processing respectively corresponding to a predetermined number of speaking lengths of pitches in a higher range of the piano, performing the first loop processing corresponding to each speaking length of a lower pitch than the pitches of the predetermined number of speaking lengths, and not performing the second loop processing corresponding to the speaking length of the lower pitch or disabling the second loop processing corresponding to the speaking length of the lower pitch.

In the embodiment, the second excitation signal may be a same signal as the first excitation signal or may be a signal generated by a process of the first excitation signal.

In the embodiment, the second excitation signal may be a signal acquired by enhancement of an attack of the first excitation signal.

In the embodiment, the second pitch may be a pitch having a resonance frequency of a front duplex or a rear duplex corresponding to the predetermined speaking length of the piano.

In the embodiment, the resonance signal generating method may further include generating a sound signal indicating a musical performance sound of a predetermined tone color in response to a detected musical performance operation, and supplying the generated sound signal to the first loop processing as the first excitation signal and supplying the generated sound signal without modification or a signal acquired by a process of the generated sound signal to the second loop processing as the second excitation signal, wherein the outputting the first and second resonance signals may include adding the generated sound signal and the first and second resonance signals to one another and outputting a signal acquired by addition.

A resonance signal generating device according to yet another aspect of the present invention includes a first resonance signal generator that includes a first loop including a first delayer that delays a signal by a time corresponding to a first pitch and a first attenuator that attenuates the signal, and a first excitation inputter that inputs a first excitation signal to the first loop, the first pitch being a pitch having a resonance frequency of a predetermined speaking length of a piano, a second resonance signal generator that includes a second loop including a second delayer that delays the signal by a time corresponding to a second pitch and a second attenuator that attenuates the signal, and a second excitation inputter that inputs a second excitation signal to the second loop, the second pitch not being a pitch having a resonance frequency of any of speaking lengths of the piano or a pitch of a harmonic thereof but being higher than the first pitch, and an outputter that outputs a first resonance signal circulating through the first loop and a second resonance signal circulating through the second loop.

In the embodiment, the first resonance signal generator may generate the first resonance signal circulating through the first loop by adding the signal attenuated by the first attenuator and the input first excitation signal to each other, delaying the added signal by the first delayer and attenuating the signal delayed by the first delayer by the first attenuator, and the second resonance signal generator may generate the second resonance signal circulating through the second loop by adding the signal attenuated by the second attenuator and the input second excitation signal to each other, delaying the added signal by the second delayer and attenuating the signal delayed by the second delayer by the second attenuator.

In the embodiment, the first and second excitation signals may be sound signals that are generated based on a common musical performance operation.

In the embodiment, the resonance signal generating device may further include an attenuation inputter that adds the first and second resonance signals to each other and attenuates the added first and second resonance signals, and inputs the signals acquired by addition and attenuation to the first and second loops.

In the embodiment, the first and second resonance signal generators may include a plurality of sets of the first and second resonance signal generators respectively corresponding to a plurality of speaking lengths of the piano, and a second pitch in the second loop of the second resonance signal generator of each set does not have to be a pitch having a resonance frequency of any of the speaking lengths of the piano or a pitch of a harmonic thereof.

In the embodiment, the first and second resonance signal generators may include a plurality of sets of the first and second resonance signal generators respectively corresponding to a predetermined number of speaking lengths of pitches in a higher range of the piano, may include a first resonance signal generator corresponding to each speaking length of a lower pitch than the pitches of the predetermined number of speaking lengths, and do not have to include a second resonance signal generator corresponding to each speaking length of the lower pitch or may disable the second loop of the second resonance signal generator corresponding to each speaking length of the lower pitch.

In the embodiment, the second pitch may be a pitch having a resonance frequency of a front duplex or a rear duplex corresponding to the predetermined speaking length of the piano.

In the embodiment, the resonance signal generating device may further include a sound signal generator that generates a sound signal indicating a musical performance sound of a predetermined tone color in response to a detected musical performance operation, wherein the first resonance signal generator may supply the sound signal generated by the sound signal generator to the first loop as the first excitation signal, the second resonance signal generator may supply the sound signal without modification generated by the sound signal generator or a signal acquired by a process of the generated sound signal to the second loop as the second excitation signal, and the outputter may add the sound signal generated by the sound signal generator and the first and the second resonance signals to one another and outputs a signal acquired by addition.

An electronic musical apparatus according to yet another aspect of the present invention includes the above-mentioned resonance signal generating device, a sound signal generator that generates a sound signal indicating a musical performance sound of a predetermined tone color in response to a detected musical performance operation, a supplier that supplies the sound signal generated by the sound signal generator to the first loop of the resonance signal generating device as the first excitation signal and supplies the generated sound signal without modification or a signal acquired by a process of the generated sound signal to the second loop of the resonance signal generating device as the second excitation signal, and a sound signal outputter that adds the sound signal generated by the sound signal generator and a sound signal output from an outputter of the resonance signal generating device to each other and outputs a sound signal acquired by addition.

According to yet another aspect of the present invention, a non-transitory computer readable medium stores a program that allows a computer to generate a first resonance signal of a first pitch circulating through first loop processing by inputting a first excitation signal to the first loop processing including first delay that delays the signal by a time corresponding to the first pitch and first attenuation that attenuates the signal, the first pitch being a pitch having a resonance frequency of a predetermined speaking length of a piano, generate a second resonance signal of a second pitch circulating through second loop processing by inputting a second excitation signal to the second loop processing including second delay that delays the signal by a time corresponding to the second pitch and second attenuation that attenuates the signal, the second pitch not being a pitch having a resonance frequency of any of speaking lengths of the piano or a pitch of a harmonic thereof but being higher than the first pitch, and output the first resonance signal circulating through the first loop and the second resonance signal circulating through the second loop.

Further, a resonance signal generating device according to yet another aspect of the present invention includes a first resonance signal generating circuit that includes a first loop circuit including a first delay circuit that delays a signal by a time corresponding to a specific first pitch and a first attenuation circuit that attenuates the signal and a first excitation input circuit that inputs a first excitation signal to the first loop circuit, a second resonance signal generating circuit that includes a second loop circuit including a second delay circuit that delays the signal by a time corresponding to a specific second pitch that is higher than the first pitch and a second attenuation circuit that attenuates the signal, and a second excitation input circuit that inputs a second excitation signal to the second loop circuit, and an output circuit that outputs a first resonance signal circulating through the first loop circuit and a second resonance signal circulating through the second loop circuit, the first pitch being a pitch having a resonance frequency of a predetermined speaking length of a piano, and the second pitch being a pitch having a resonance frequency of a front duplex or a rear duplex corresponding to the speaking length.

The present invention can be applied in any embodiment such as a device, a method, a system, a program and a medium storing the program in addition to the above-mentioned embodiments.

Other features, elements, characteristics, and advantages of the present invention will become more apparent from the following description of preferred embodiments of the present invention with reference to the attached drawings.

DESCRIPTION OF THE PREFERRED EMBODIMENTS

Embodiments of the present invention will be specifically described below based on the drawings.

Figure 1:
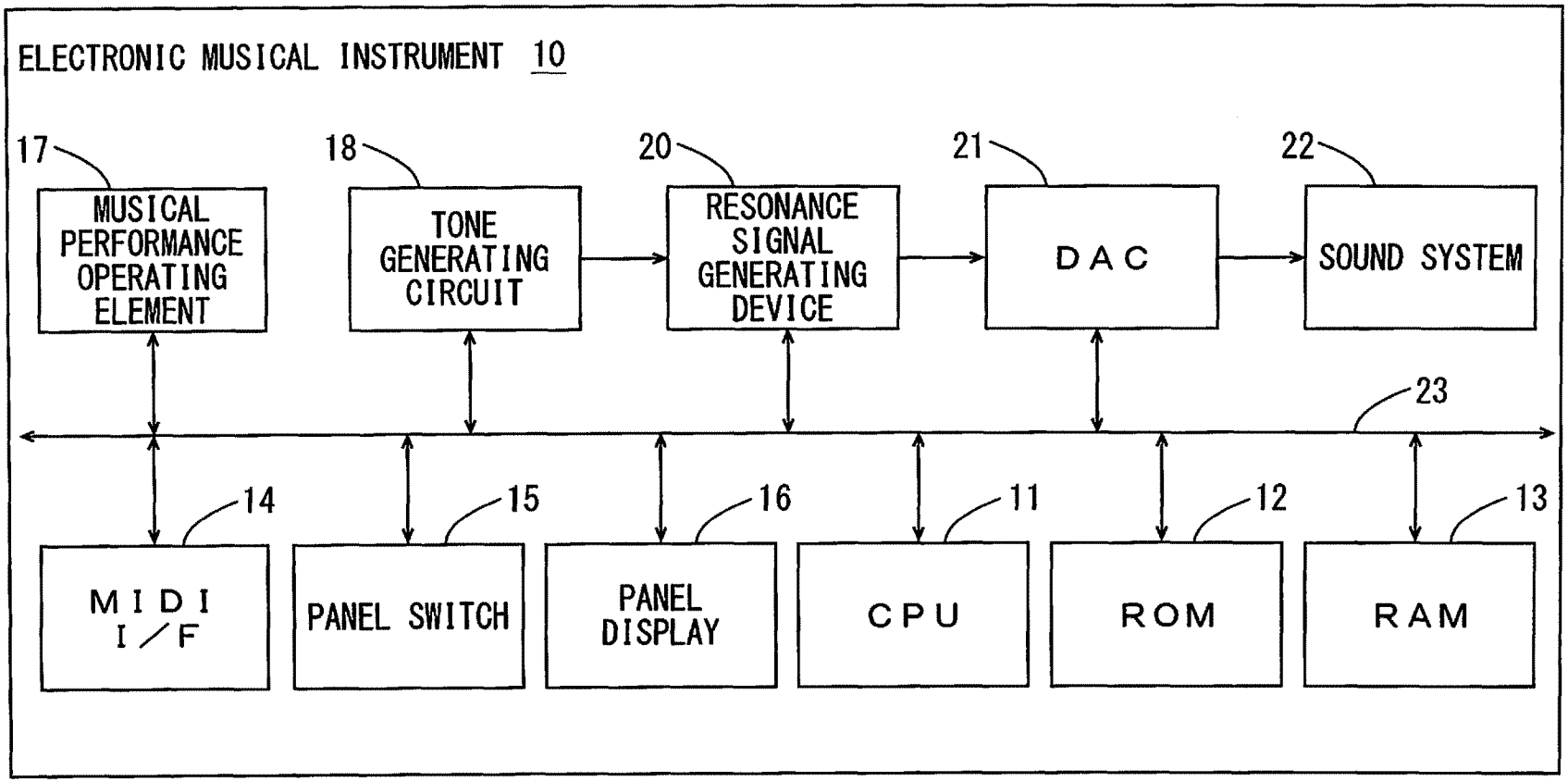
FIG. 1 is a block diagram showing the hardware configuration of an electronic musical instrument according to one embodiment of an electronic musical apparatus including a resonance signal generating device according to one embodiment of the present invention.

First, an electronic musical instrument according to one embodiment of an electronic musical apparatus including a resonance signal generating device according to the one embodiment of the present invention will be described. FIG. 1 is a diagram showing the hardware configuration of the electronic musical instrument.

As shown in this diagram, the electronic musical instrument 10 is provided with a CPU (Central Processing Unit) 11, a ROM (Read Only Memory) 12, a RAM (Random Access Memory) 13, a MIDI (Musical Instrument Digital Interface: registered trademark)_I/F (interface) 14, a panel switch 15, a panel display 16, a musical performance operating element 17, a tone generating circuit 18, a resonance signal generating device 20, a DAC (Digital-to-Analog Converter) 21 which are connected with a system bus 23, and is provided with a sound system 22.

The CPU 11 among these components is a controller that controls the electronic musical instrument 10 as a whole. The CPU 11 performs control operations of detecting an operation of the panel switch 15 or the musical performance operating element 17, controlling the display in the panel display 16, controlling the communication through the MIDI_I/F 14, controlling generation of a sound signal by the tone generating circuit 18 and the resonance signal generating device 20, controlling the DA conversion by the DAC 21, etc. by executing a control program stored in the ROM 12.

The ROM 12 is a rewritable non-volatile storage, such as a flash memory, which stores data that is not required to be changed too frequently such as a control program to be executed by the CPU 11, screen data representing the contents of the screen to be displayed in the panel display 16 and data of various parameters to be set in the tone generating circuit 18 and the resonance signal generating device 20.

The RAM 13 is a storage that is used as a working memory for the CPU 11.

The MIDI_I/F 14 is an interface for inputting and outputting MIDI data from or to an external device such as a MIDI sequencer that provides musical performance data representing a musical performance operation and the contents of musical performance such as designation of a tone color.

The panel switch 15 is an operating element such as a button, a knob, a slider or a touch panel that is provided on the operation panel of the electronic musical instrument 10, and is an operating element for receiving various instructions from a user such as settings of parameters and switching of screens or operation modes.

The panel display 16 is constituted by a liquid crystal display (LCD), a light emitting diode (LED) lamp and the like, and is a display unit for displaying an operational state and contents of settings of the electronic musical instrument 10, a message to the user, a graphical user interface (GUI) for receiving instructions from the user and so on.

The musical performance operating element 17 is an operating element for receiving a musical performance operation from the user, and includes a keyboard and a pedal such as the ones provided in a piano.

The tone generating circuit 18 is a sound signal generator that generates a sound signal (digital waveform data) indicating a musical performance sound of a predetermined tone color (a tone color of a piano, for example) according to a MIDI event that is generated by the CPU 11 in response to a detected operation of the musical performance operating element 17 or received from the MIDI_I/F 14.

For example, in response to detection of a note-on event, the tone generating circuit 18 can generate digital waveform data of the sound generated by the depression of the key corresponding to the pitch designated by the note-on event. As for the tone color of the piano, the tone generating circuit 18 can use the digital waveform data that is stored in a predetermined waveform memory in advance. In this case, keys of the actual piano are depressed one by one, and the sound generated by key depressions is stored in the waveform memory in advance in the form of the digital waveform data by the PCM (Pulse Code Modulation) method.

Such digital waveform data is stored in the waveform memory to correspond to the pitch corresponding to each key (and the velocity of a key depression). When the note-on event is detected, the tone generating circuit 18 can generate the waveform data corresponding to the key depression by reading the waveform data corresponding to the pitch (and the velocity) included in the event from the waveform memory and performing envelope processing or the like corresponding to the velocity and outputting the processed data. The tone color to be used can be selected from a plurality of candidates. The candidates may include the tone colors of a plurality of types of musical instruments or may include the tone colors of a plurality of different models of the same type of a musical instrument (a piano, for example).

Further, the tone generating circuit 18 outputs the generated sound signal to the sound system 22 through the resonance signal generating device 20 and the DAC 21. The CPU 11 may set the resonance signal generating device 20 such that all or part of the sound signal generated by the tone generating circuit 18 can be output without going through the resonance signal generating device 20.

Figure 2:
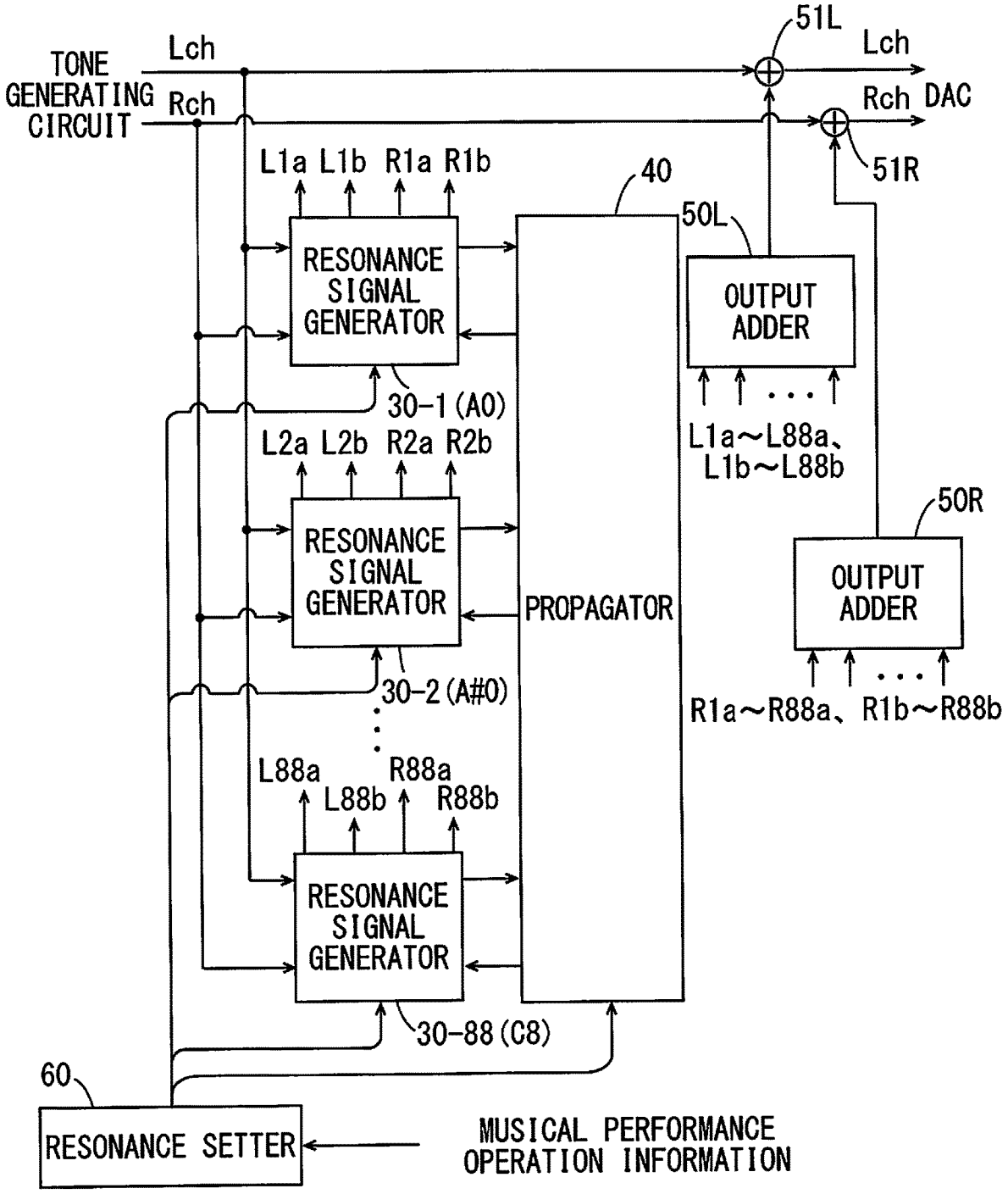
FIG. 2 is a diagram showing a schematic functional configuration of the resonance signal generating device shown in FIG. 1.
Figure 3:
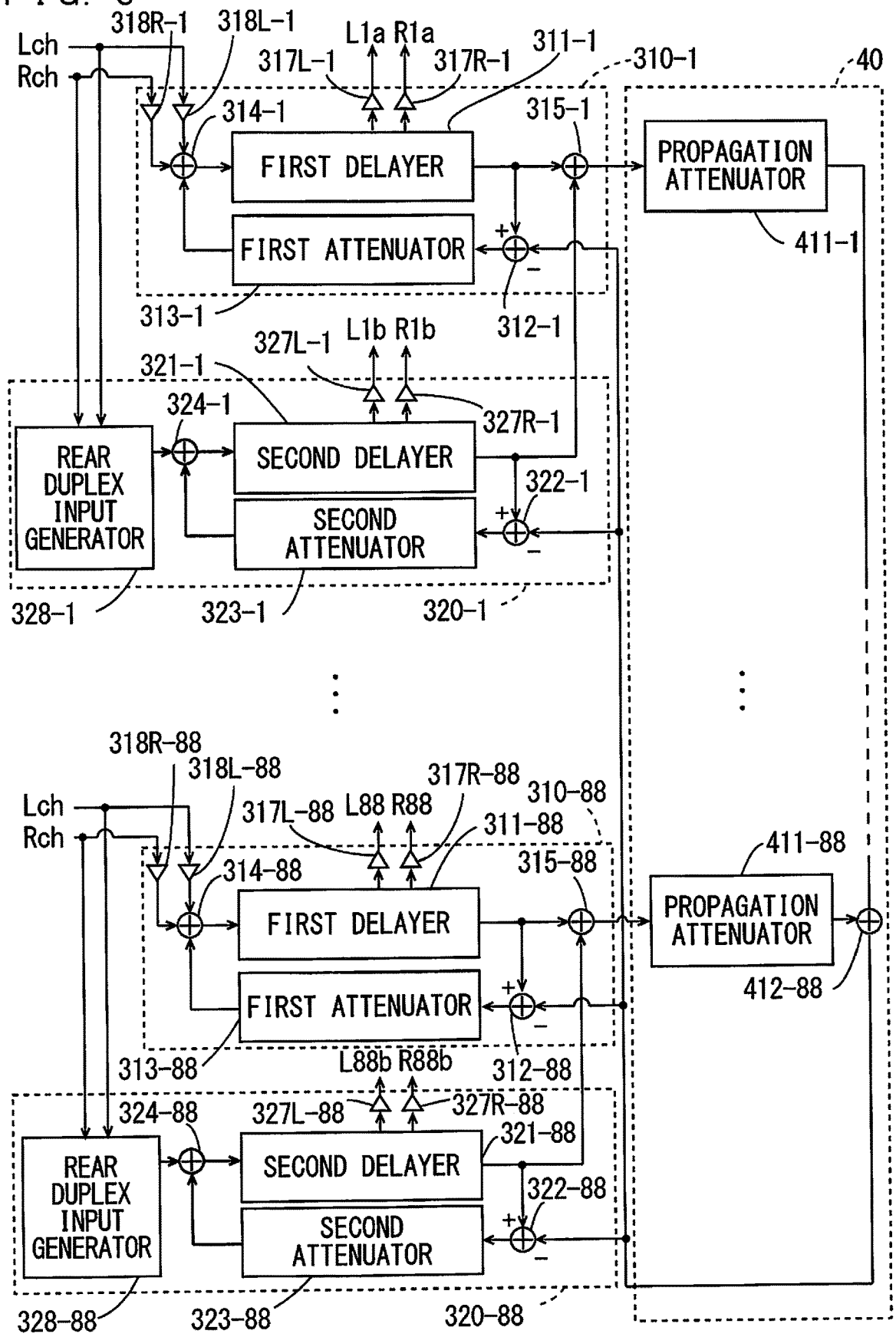
FIG. 3 is a diagram showing the functional configurations of the resonance signal generators and a propagator shown in FIG. 2 in further detail.

The resonance signal generating device 20 is one embodiment of the resonance signal generating device of the present invention, and generates a resonance signal simulating the resonance of a string excited by an input sound signal by performing the processing described in FIGS. 2, 3 and the like based on the sound signal that is input from the tone generating circuit 18. Further, the resonance signal generating device 20 adds this resonance signal to the sound signal that is input from the tone generating circuit 18 and outputs the added sound signal to the DAC 21.

The DAC 21 converts the digital sound signal that is output by the resonance signal generating device 20 into an analogue signal, and drives a speaker that constitutes the sound system 22. The sound system 22 is not required when the electronic musical instrument 10 is configured to output not sound but a sound signal. The DAC 21 is not required either when the electronic musical instrument 10 is configured to output not analogue but digital waveform data.

The above-mentioned electronic musical instrument 10 can generate a sound signal based on the musical performance with a resonance sound simulating the resonance of strings added, and output sound produced by the generated sound signal based on a user's musical performance operation detected by the musical performance operating element 17 or musical performance data received by the MIDI_I/F 14 from external equipment.

One of the features of this electronic musical instrument 10 is the configuration and operation of the resonance signal generating device 20 and will be described next.

First, FIG. 2 shows the schematic functional configuration of the resonance signal generating device 20. The function of each component shown in FIG. 2 may be realized by a dedicated circuit, execution of software by a processor or a combination of these. The same applies to the function of each component shown in FIG. 3 and the subsequent corresponding diagrams.

The resonance signal generating device 20 shown in FIG. 2 is configured to simulate the resonance of strings in the piano having 88 keys, by way of example, and includes resonance signal generators 30 that correspond to the pitches from the lowest pitch A0 (1st) to the highest pitch (C8) (88th). In the reference numeral "30-1," the number following the hyphen indicates which pitch the constituent element corresponds to. However, when it is not necessary to distinguish the plurality of constituent elements from one another, the number following the hyphen is omitted, and a numeral reference such as "30" is used. This applies to other numeral references that include numbers following the hyphens.

Further, the resonance signal generating device 20 includes a propagator 40, output adders 50L, 50R, adders 51L, 51R, a resonance setter 60 in addition to the resonance signal generators 30.

Each resonance signal generator 30 among these components includes the function of receiving a sound signal supplied from the tone generating circuit 18 as an excitation signal and generating a resonance signal that simulates the resonance excited by the excitation signal for a string of the corresponding pitch, based on the sound signal. Here, each resonance signal generator 30 receives the sound signals of 2 channels of L and R and outputs the resonance signals of 2 channels of L and R from a first resonance signal generator 310 and a second resonance signal generator 320 respectively as described below. Therefore, as for the resonance signals that are output by each resonance signal generator 30, the signals that are output by the first resonance signal generator 310 are referred to as Lna, Rna, and the signals that are output by the second resonance signal generator 320 are referred to as Lnb, Rnb (n is the number indicating the pitch.) Further, "a string of the corresponding pitch" includes a front duplex and a rear duplex in addition to a speaking length.

The propagator 40 includes the function of carrying out the calculation to simulate how bridges over which a plurality of strings are strung propagate vibration energy between strings. Each resonance signal generator 30 generates resonance signals while receiving a signal from this propagator 40. The functions of each resonance signal generator 30 and the propagator 40 will be described below with reference to FIG. 3.

The output adder 50L includes the function of adding all of resonance signals L1*a* to L88*a* and L1*b* to L88*b* of the L channel that are output respectively by the resonance signal generators 30 to one another and generating a resonance signal of the L channel as the output of the resonance signal generating device 20. The output adder 50R includes the function of similarly adding resonance signals R1*a* to R88*a* and R1*b* to R88*b* to one another and generating a resonance signal of the R channel.

The adders 51L, 51R are sound signal outputters and include the function of respectively adding the resonance signals generated by the output adders 50L, 50R to the sound signals supplied from the tone generating circuit 18 and outputting the added sound signals to the DAC 21. The adder 51L handles the sound signal of the L channel, and the adder 51R handles the sound signal of the R channel.

The resonance setter 60 includes the function of setting necessary parameters for each component of the resonance signal generating device 20 according to the musical performance data supplied from the CPU 11 at the time of start-up of the resonance signal generating device 20 or after the start-up. The parameters that are set by the resonance setter 60 will be described below in detail with reference to FIGS. 6 and 7.

Next, FIG. 3 shows the functional configurations of the resonance signal generators 30 and the propagator 40 shown in FIG. 2 in further detail.

FIG. 3 representatively shows only the resonance signal generators 30 corresponding to the first and 88th pitches. Each resonance signal generator 30 includes a set of a first resonance signal generator 310 and a second resonance signal generator 320.

Each first resonance signal generator 310 of these components includes a first loop including a first delayer 311, an adder 312, a first attenuator 313 and an adder 314. Each first resonance signal generator 310 further includes an adder 315 and level adjustors 317L, 317R, 318L, 318R.

The first delayer 311 among these components includes the function of delaying a sound signal by holding each sample of an input sound signal for the time indicated by a delay amount DL set by the resonance setter 60 and then outputting the held sample. This first delayer 311 can be constituted by a buffer memory in which an output time point is settable on a sampling period basis of the sound signal. Further, the first delayer 311 can be constituted by a plurality of delay elements sequentially connected to one another. In such a first delayer 311, a position from which the sound signal is to be output is selectable from among the plurality of connection positions of the plurality of delay elements. Further, when the delay amount is to be set more finely than on a sampling period basis, a delay circuit using a primary all-pass filter as described in the JP 2015-143763 A may be provided in addition to the circuit that delays the sound signal on a sampling period basis.

Further, the first delayer 311 includes the function of outputting the input and held sound signal. The levels of these outputs are adjusted by the level adjustors 317L, 317R respectively, and these outputs are input to the output adders 50L, 50R of FIG. 2 as resonance signals of the L and R channels that are output by the resonance signal generator 310.

The adder 312 includes the function of adding a sound signal that is output by the first delayer 311 and a sound signal supplied from the propagator 40 to each other for every sample. That is, the adder 312 includes the function of inputting the energy of the sound signal supplied from the propagator 40 to the first loop. In order to simulate the waveform reflection at the bridge, the adder 312 inputs the sound signal supplied from the propagator 40 by subtraction (the positive and negative of the sound signal are inverted, and then the inverted sound signals are added.)

The first attenuator 313 includes the function of attenuating the sound signal supplied from the adder 312 in accordance with the gain value set by the resonance setter 60. As described below, the resonance setter 60 sets the gain value simulating the state of a damper corresponding to the string for the first attenuator 313. As for the string against which the damper is abutting, the first attenuator 313 sets the gain value to 0 and simulates the sudden stop of string vibration. As for the string from which the damper is released, the first attenuator 313 sets the gain value to a value close to and smaller than 1, gradually attenuates the level of the signal to simulate the attenuation of the string vibration.

The adder 314 includes the function of a first excitation inputter that inputs a first excitation signal to the first loop by adding the excitation signals supplied from the tone generating circuit 18 and a sound signal that is output by the first attenuator 313 to each other.

In the present embodiment, the tone generating circuit 18 supplies the generated sound signals of the L and R channels to the resonance signal generating device 20. Therefore, when a plurality of keys are simultaneously depressed, and sound signals of a plurality of pitches are simultaneously generated in the tone generating circuit 18, the generated sound signals are supplied to the resonance signal generating device 20. Then, each first resonance signal generator 310 adjusts the respective levels of the sound signals of L and R channels by the respective level adjustors 318L, 318R and inputs the adjusted sound signals to the first loop through the adder 314 as excitation signals. These level adjustors 318L, 318R and the adder 314 are equivalent to a supplier of a first resonance signal generator 310.

For example, when the gain values set in the level adjustors 318L, 318R are both 1, the excitation signal that is input to the first resonance signal generator 310 is a sound signal that is acquired by simple addition of the sound signals of the L and R channels supplied from the tone generating circuit 18 to each other. However, the levels of the L and R channels may be individually adjustable.

In the above-mentioned first resonance signal generators 310, the constituent elements and the operations corresponding to the x-th pitch are described, by way of example. The value of a delay amount DL1 (x) is set in a first delayer 311-*x* such that the time required for one processing cycle by the first loop equals to one period of the sound of the x-th pitch (a first pitch) (a reciprocal of the resonance frequency of the string of the x-th pitch). Thus, the component of the resonance frequency in the first excitation signal (and components of its harmonics) is enhanced by addition of the signal that has been delayed by the first delayer 311 and the first excitation signal of the next cycle to each other, and a first resonance signal having the resonance frequency of the speaking length of the x-th pitch circulates through the first loop (the sound signal is subjected to the loop processing in the first loop.) Thus, the first resonance signal generator 310 can simulate the resonance of the speaking length of the x-th pitch.

That is, the first resonance signal generator 310 can perform first resonance signal procedure that inputs the first excitation signal to first loop processing including the first delay of the time corresponding to the x-th pitch and the first attenuation, and generates first resonance signal of the x-th pitch circulating through the above-mentioned first loop processing.

The sound signal that is input from the propagator 40 through the adder 312 has an effect on a resonance signal formed in the first loop similarly to an excitation signal that is input from the adder 314. However, because not having a sudden effect on the resonance signal as described below (the gain value of a propagation attenuator 411 is set not to cause the sudden effect,) the sound signal is not included in the excitation signal.

The first resonance signal generator 310 includes the function of supplying the output (the first resonance signal) of the first delayer 311 to the propagator 40 through the adder 315 in addition to the above-mentioned function.

On the other hand, each second resonance signal generator 320 includes a second loop including a second delayer 321, an adder 322, a second attenuator 323 and an adder 324. The second delayer 321 also includes the function of outputting the input and held sound signal similarly to the first delayer 311. The levels of the outputs are adjusted by the level adjustors 327L, 327R respectively, and the adjusted outputs are input to the output adders 50L, 50R of FIG. 2 as resonance signals of L and R channels that are output by the second resonance signal generator 310.

While the functions of components that form this second loop are mostly the same as the functions of the first delayer 311, the adder 312, the first attenuator 313 and the adder 314 that respectively form the first loop, there are also many differences.

The constituent elements and the operations corresponding to the x-th pitch are described by way of example. The value of a delay amount DL2 (x) is set in the second delayer 321-*x* by the resonance setter 60 such that the time required for one processing cycle of by the second loop equals to one period corresponding to a resonance frequency of the rear duplex of the x-th pitch (a reciprocal of the resonance frequency).

The gain value that is set in a second attenuator 323-*x* is the value indicating the vibration attenuation rate in the rear duplex.

Further, a rear duplex input generator 328-*x* generates a second excitation signal based on the sound signals of 2 channels of L and R that are the same as the signals supplied from the tone generating circuit 18 and supplied to the first resonance signal generator 301. An adder 324-*x* includes the function of a second excitation inputter of inputting a second excitation signal to the second loop by adding the second excitation signal generated by the rear duplex input generator 328-*x* and the sound signal output by the second attenuator 323-*x* to each other.

Thus, in a second resonance signal generator 320-*x*, the component of the resonance frequency of the rear duplex of the x-th pitch (and components of its harmonics) in the second excitation signal is enhanced, and the second resonance signal having the resonance frequency of the rear duplex of the x-th pitch circulates through the second loop (the sound signal is subjected to the loop processing in the second loop.) Thus, the second resonance signal generator 320 can simulate the resonance of the rear duplex of the x-th pitch.

That is, the second resonance signal generator 320 can perform the second resonance signal generation procedure that inputs a second excitation signal to second loop processing including second delay of the time corresponding to the pitch having the resonance frequency of the rear duplex of the x-th pitch and the second attenuation, and generates the second resonance signal circulating through the above-mentioned second loop processing.

Figure 4:
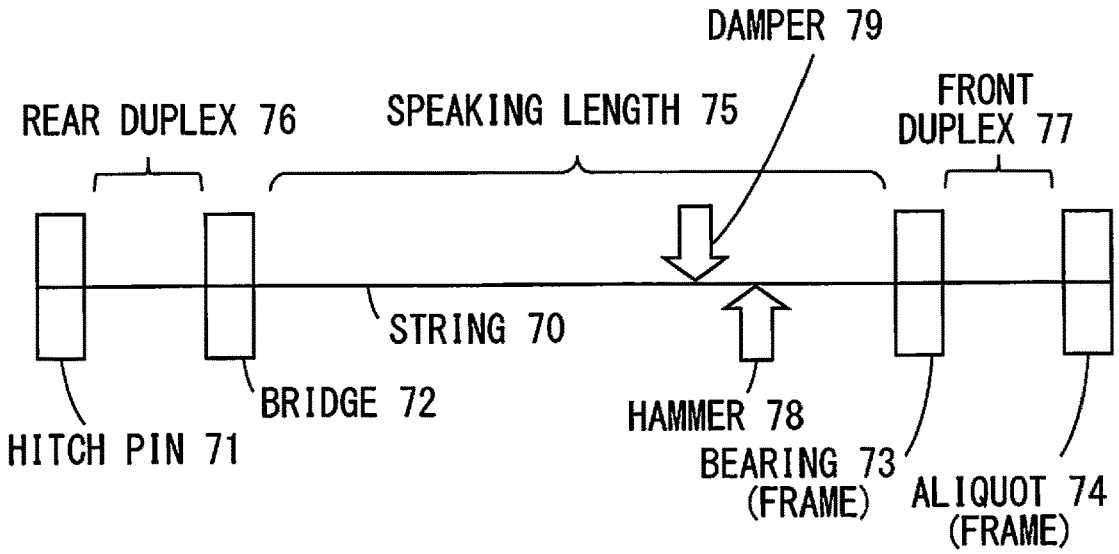
FIG. 4 is a diagram schematically showing the configuration of a string of a piano that is assumed in the embodiment.

Here, FIG. 4 schematically shows the configuration of a string in an assumed piano in this embodiment.

Generally, a string 70 of each pitch is strung over a hitch pin 71, a bridge 72, a bearing 73 and an aliquot 74 in the piano. The bearing 73 and the aliquot 74 among these components are both parts of a frame. The string 70 is strung by the hitch pin 71 and the aliquot 74, so that tension is applied to the string 70. Vibration of the portions of the string 70 at the bridge 72 and the bearing 73 is stopped since the portions are pressed against the bridge 72 and bearing 73. Thus, three parts of the string 70 vibrate dividedly.

The portion between the bridge 72 and the bearing 73 is a speaking length 75, and the piano is tuned such that the resonance frequency of this speaking length 75 corresponds to a pitch that is desirable for a musical performance sound. Further, a hammer 78 generates a musical performance sound by hitting this speaking length 75, and a damper 79 stops the musical performance sound by stopping vibration of the speaking length 75.

Further, the portion between by the hitch pin 71 and the bridge 72 is a rear duplex 76, and the portion between by the bearing 73 and the aliquot 74 is a front duplex 77. Neither the rear duplex 76 nor the front duplex 77 is hit, and vibration of neither the rear duplex 76 nor the front duplex 77 is stopped by the damper. Both of the rear duplex 76 and the front duplex 77 can generate sound by vibrating due to the vibration energy of the corresponding speaking length 75 or other strings, the vibration energy being propagated through the bridge 72 or the frame (the bearing 73 and aliquot 74).

Generally, the rear duplex 76 and the front duplex 77 are shorter than the speaking length 75, and its tension and material are uniform in the entire length of the string 70. Therefore, the resonance frequencies of the rear duplex 76 and the front duplex 77 are larger than that of the speaking length 75, and the rear duplex 76 and the front duplex 77 generate a higher pitch sound as compared to the speaking length 75.

As described above, the rear duplex 76 and the front duplex 77 of the x-th pitch are common to each other in that both have resonance frequencies much higher than that of the speaking length 75 of the x-th pitch. Although these resonance frequencies are not necessarily the same, a second resonance signal corresponding to a pitch (second pitch) much higher than the x-th pitch is generated by the second resonance signal generator 320 simulating the rear duplex 76. Further, the correspondence relationship between the resonance frequencies of the rear duplex 76 and the front duplex 77 and the pitch of the speaking length 75 is not necessarily settled or well known. Therefore, whether the second resonance signal is a signal simulating the resonance of the rear duplex 76 or a signal simulating the resonance of the front duplex 77 may not be distinguishable depending on a listener. Therefore, the second resonance signal can be regarded as a signal integrally simulating the resonance sounds of the front duplex 77 and the rear duplex 76. As described in a modified example below, the front duplex 77 and the rear duplex 76 can be separately simulated, as a matter of course. Based on this concept, even when the second pitch does not necessarily match the resonance frequency of the front duplex 77 or the rear duplex 76 in a specific piano, the signal simulating the resonance sounds of the front duplex 77 and/or the rear duplex 76 can be generated.

The delay amount DL2 (x) is set in the second delay portion 321-*x* not to correspond to the resonance frequency of the speaking length or the frequency of its harmonics. That is, the pitch of the second resonance signal is set not to be a pitch of any of speaking lengths or their harmonics. This is because of the following reason. If the pitch of the second resonance signal in a specific second resonance signal generator 320 is equal to a pitch of any of speaking lengths or its harmonics, only the second resonance signal generator 320 may generate a strong resonance signal in response to the vibration of the speaking length, which may be harsh. Therefore, such a situation need to be prevented. Further, there is no difficulty in simulation of the resonance sounds of the front duplex 77 and/or the rear duplex 76 even when a pitch of a speaking length or its harmonics is not used.

Figure 5:
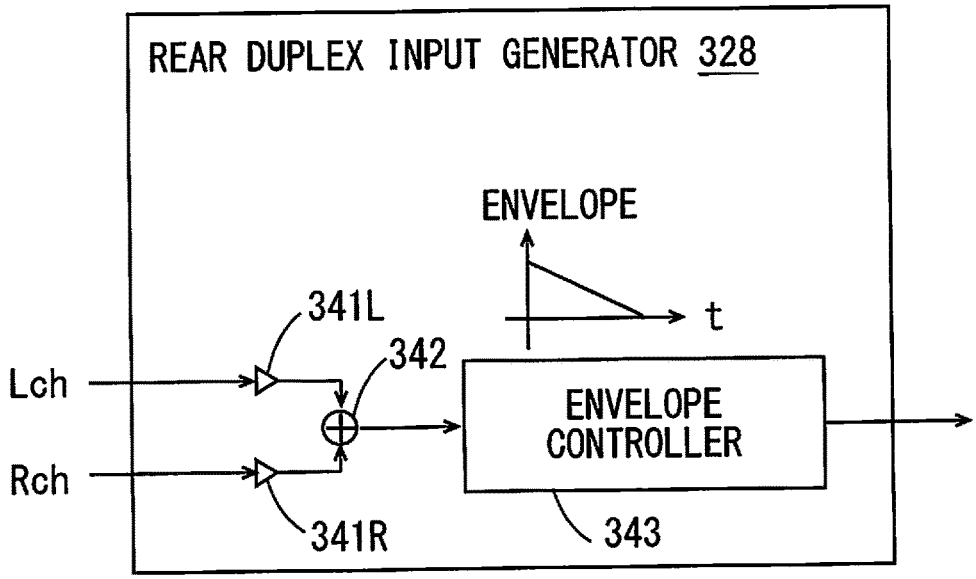
FIG. 5 is a diagram showing the functional configuration of a rear duplex input generator shown in FIG. 3 in further detail.

The functional configuration of a rear duplex input generator 328 is shown in FIG. 5.

As shown in FIG. 5, the rear duplex input generator 328 includes level adjustors 341L, 341R, an adder 342 and an envelope controller 343.

The level adjustors 341L, 341R among these components include the functions of adjusting the levels of the sound signals of L and R respectively that are supplied from the tone generating circuit 18. Since a rear duplex (or a front duplex) does not have a damper, to reflect this, fixed values are always set in the level adjusters 341L, 341R differently from the values set in the level adjusters 318L, 318R of the first resonance signal generator 310.

The adder 342 adds the sound signals of L and R after the level adjustment is carried out by the level adjusters 341L, 341R.

The envelope controller 343 includes the function of generating a second excitation signal by multiplying the sound signal that is acquired by addition by the adder 342 by the envelope (shown above the envelope controller 343 of FIG. 5 in the graph) that enhances an attack portion and extracting the attack portion from the sound signal. The shape of the envelope is not limited to the shape shown in FIG. 5, and may be the shape acquired by extraction of only a steeper attack portion from the sound signal.

Further, when it is difficult to provide the above-mentioned rear duplex input generator 328 due to restriction of the resources or the like, the same signal as a first excitation signal may be used as a second excitation signal.

Further, the second resonance signal generator 320 also includes the function of supplying the output (second resonance signal) of the second delayer 321 to the propagator 40 through the adder 315 in addition to the above-mentioned function. The adder 315 adds the first resonance signal and the second resonance signal to each other, and supplies the sound signal acquired by addition (sound signal of sum) to the propagator 40.

Next, the propagator 40 includes propagation attenuators 411 respectively corresponding to the resonance signal generators 30 and adders 412 respectively corresponding to the second and subsequent resonance signal generators 30. The propagator 40 includes the function of receiving the sound signal of sum supplied from the adder 315 of each resonance signal generator 30, attenuating the sound signal by the corresponding propagation attenuator 411 and then adding the attenuated sound signal and the sound signal attenuated by another propagation attenuator 411 to each other by each adder 412.

Further, the propagator 40 includes the function of inputting the sound signal added by the adder 412-88 corresponding to all of the strings to the first resonance signal generator 310 and the second resonance signal generator 320 of each resonance signal generator 30. More specifically, the propagator 40 inputs the added sound signal to the first loops through the adders 312, and inputs the added sound signal to the second loops through the adders 322. That is, the propagator 40 functions as a propagation inputter along with the adders 312 and the adders 322.

The attenuation processing in each propagation attenuator 411 is performed based on a gain value a that is set by the resonance setter 60. The propagation of vibration energy to be simulated by this propagator 40 is slow, so that the value of a is a positive value close to 0 in reflection to this. A common value or different values may be set for the propagation attenuators 411 of respective pitches.

The above-mentioned propagator 40 adds the sound signals that are input from respective resonance signal generators 30 to one another and returns the results of addition to all of the resonance signal generators 30, thereby being able to simulate how the vibration of one string is propagated to another string through a soundboard or a bridge, for example. In the case where a bridge is divided into a plurality of parts, when simulation is carried out to simulate how the bridges do not vibrate uniformly, the simulation propagators 40 respectively corresponding to the parts may be provided, sound signals that are input from the resonance signal generators 30 corresponding to the strings strung on the respective parts may be added to one another, and the result of addition may be returned to all of the resonance signal generators 30 from which the sound signals are input.

Processing of setting a value of a parameter in each component of the resonance signal generating device 20, which is performed by the resonance setter 60 shown in FIG. 2, will be described next.

Figure 6:
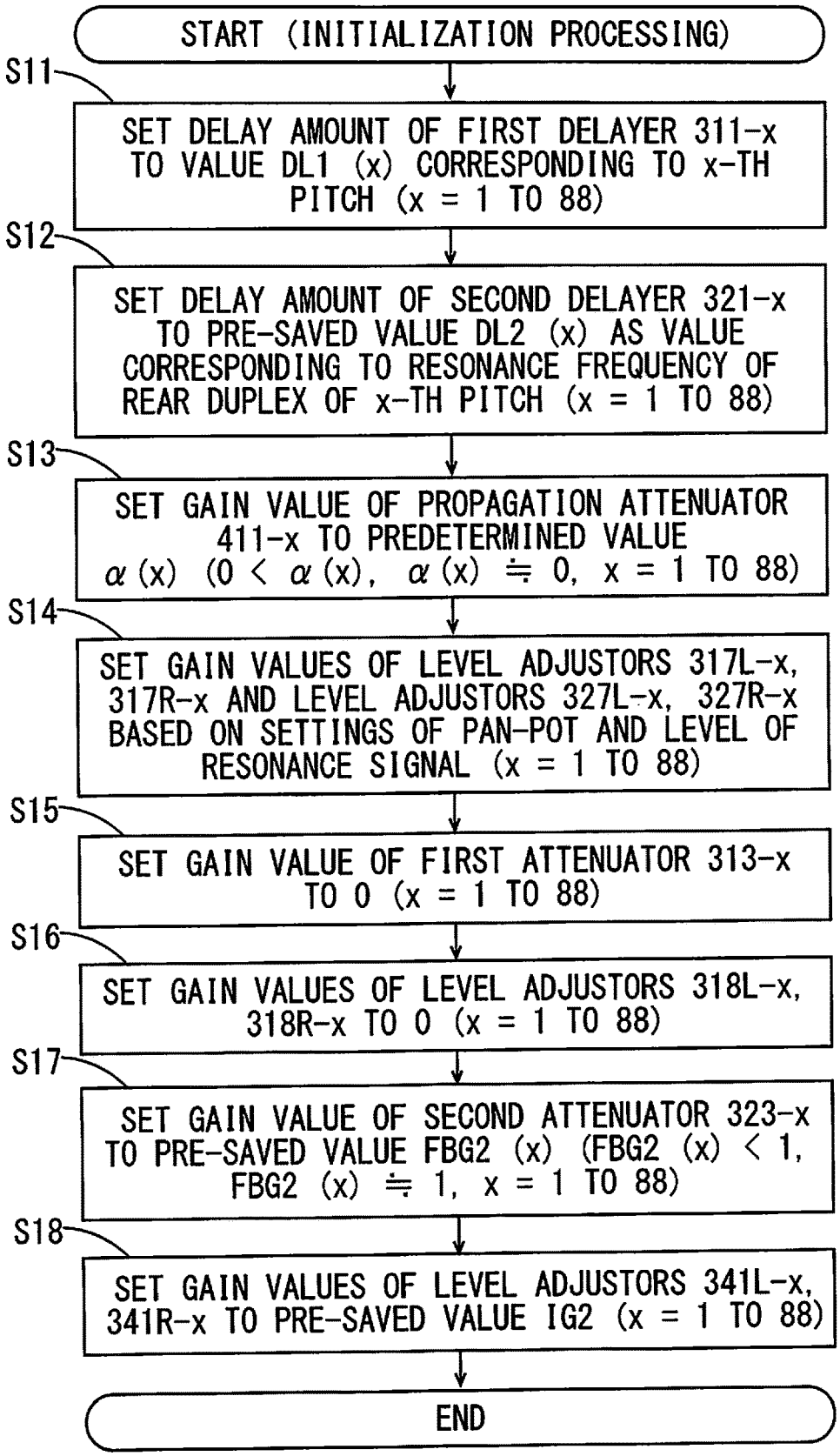
FIG. 6 is a flow chart of processing that is performed by a resonance setter shown in FIG. 2 at the time of start-up of the resonance signal generating device.

First, FIG. 6 shows a flow chart of initial setting processing that is performed by the resonance setter 60 at the time of start-up.

When the resonance signal generating device 20 is started up, the resonance setter 60 performs the processing of FIG. 6 and the initial setting of a value of a parameter in each component. Since being performed for the respective first to 88th pitches, the processing of each step in FIG. 6 is generalized as the processing relating to the x-th pitch for description.

In the processing of FIG. 6, the resonance setter 60 first sets the delay amount of a first delayer 311-*x* to a value DL1 (x) corresponding to the x-th pitch (the resonance frequency of the speaking length 75 of the x-th pitch) (S11). The value of DL1 (x) corresponding to each value of x may be prepared in advance or obtained by calculation from the frequency of each pitch.

Next, the resonance setter 60 sets the delay amount of a second delayer 321-*x* to a value DL2 (x) corresponding to the resonance frequency of the rear duplex 76 of the x-th pitch (S12). The value without modification of the DL2 (x) corresponding to each value of x may be prepared in advance, or may be obtained by calculation from the value of each resonance frequency. As described above, it is desirable that the value of the resonance frequency of the rear duplex 76 is set not to coincide with a resonance frequency of any of speaking lengths 75 or the frequency of their harmonics.

Next, the resonance setter 60 sets the gain value of the propagation attenuator 411-*x* to a pre-saved predetermined value a (x) (S13). Each a (x) is a positive value close to 0 as described above.

Further, the resonance setter 60 sets the gain values of the level adjustors 317L-x, 317R-x and the level adjustors 327L-x, 327R-x based on the settings of the pan-pot and the level of a resonance signal that are supplied from the CPU 11 (S14). The CPU 11 also supplies the setting of the pan-pot (sound image localization position) that is the same as the setting of the pan-pot supplied to the tone generating circuit 18 to the resonance setter 60. Further, the CPU 11 also supplies the setting of level of the resonance signal to the resonance setter 60. The level of the resonance signal is set according to a user's operation or set automatically, which indicates the level of the resonance signal to be applied to the sound signal generated by the tone generating circuit 18. The gain values of the level adjustors 317L-x, 317R-x and the level adjustors 327L-x, 327R-x can be obtained by multiplication of the gain value corresponding to the LR balance by the gain value indicated by the level of the resonance signal (addition if the gain value is an index value). As for the level of the resonance signal, the values to be used for the settings of the level adjustors 317L-x, 317R-x (settings for speaking lengths), and the values to be used for the settings of the level adjustors 327L-x, 327R-x (settings for the front duplex and/or the rear duplex) may be set separately.

The resonance setter 60 further sets the gain value of the first attenuator 313-*x* to 0 (S15) and also sets the gain values of the level adjustors 318L-x, 318R-x to 0 (S16). The settings of the step S15 and S16 are made to simulate the dampers abutting against the speaking lengths 75 of all of the pitches in an initial state.

The resonance setter 60 further sets the gain value of the second attenuator 323-*x* to a pre-saved value FBG2 (x) (S17), sets the gain values of level adjustors 341L-x, 341R-x to a pre-saved IG2 (S18) and ends the processing of FIG. 6. Since the rear duplex 76 does not have a damper, the settings in the step S17 and S18 are made to simulate the resonance signal that can be generated even in the initial state.

Figure 7:
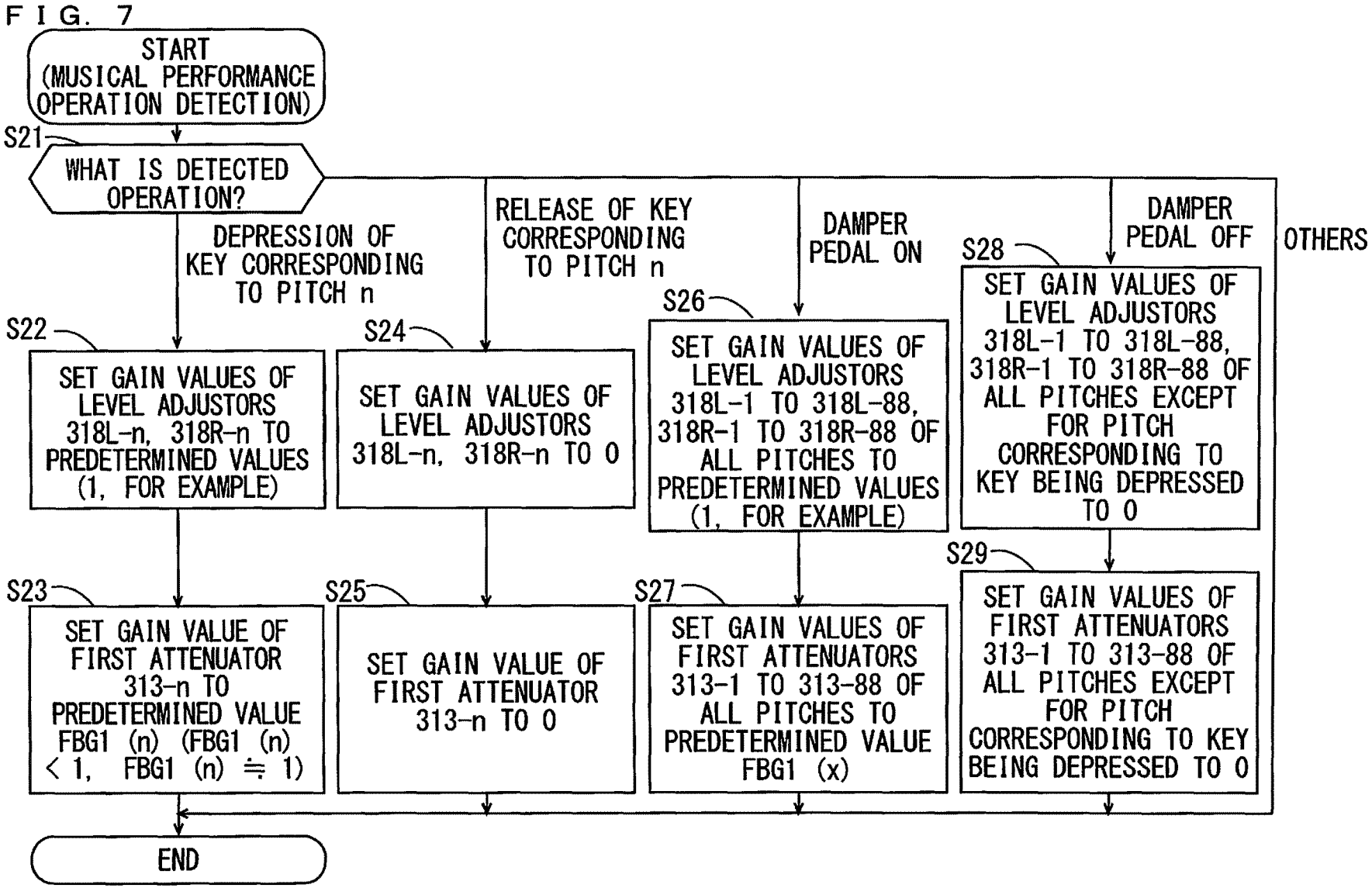
FIG. 7 is a flow chart of processing that is performed when the resonance setter detects a musical performance operation.

Next, FIG. 7 shows a flow chart of the processing performed when the resonance setter 60 detects a musical performance operation.

The CPU 11 also supplies the data pieces relating to at least a key depression, a key release and a damper pedal operation among the musical performance data supplied to the tone generating circuit 18 to the resonance signal generating device 20 at the same time. When this musical performance data is supplied after the initial setting is completed, the resonance setter 60 starts the processing shown in the flow chart of FIG. 7, assuming that a musical performance operation has been detected.

In the processing of FIG. 7, the resonance setter 60 determines the type of the detected operation (S21) and performs the processing according to the determined type.

First, when detecting an operation of depressing the key of the n-th pitch (note), the resonance setter 60 sets the gain values of both of the level adjusters 318L-n, 318R-n of the pitch n to predetermined values (S22), and sets the gain value of the first attenuator 313-*n* of the n-th pitch to a pre-saved predetermined value FBG1 (n) (S23).

In accordance with the settings made in the step S22, the sound signals supplied from the tone generating circuit 18 are input to the first resonance signal generator 310-*n* of the pitch n as an excitation signal. Further, the FBG1 (n) is the value, which is mentioned in the description of the first attenuator 313, is prepared in correspondence with the n-th pitch as the value simulating the attenuation of string vibration. These settings are made to simulate the damper being released from the string in response to a key depression, and are made such that a first resonance signal can be generated in the first loop of the n-th pitch. As for a second resonance signal generator 320-*n*, because a second resonance signal can be generated in the second loop at all times, none of the settings is to be changed in response to the operation of depressing the key.

While the gain values that are set in the step S22 may be 1, for example, the gain values may be calculated in advance based on the settings of the LR balance and the level of the resonance signal that are supplied from the CPU 11. Further, the LR balance to be used for the settings of the gain values of the level adjustors 318-Lx, 318-Rx does not necessarily be the same as the LR balance to be supplied to the tone generating circuit 18 (the LR balance to be used for the settings of the gain values of the level adjustors 317L-x, 317R-x), and may be set separately for adjusting the input to the resonance sound generating circuit 30. The LR balance may be set for every pitch or every predetermined number of pitches.

Next, when an operation of releasing the key of the n-th pitch is detected, the resonance setter 60 sets both of the gain values of the level adjustors 318L-n, 318R-n of the n-th pitch to 0 (S24), and sets the gain value of the first attenuator 313-*n* of the n-th pitch to 0 (S25).

In accordance with the settings made in the step S24, an excitation signal is not input to the first resonance signal generator 310-*n* of the n-th pitch. In accordance with the setting made in the step S25, the resonance signal that has been circulating through the first loop is quickly attenuated and substantively not output from the first resonance signal generator 310-*n*. These settings are made to simulate the damper abutting against the string in response to a key release. As for the second resonance signal generator 320-*n*, because no damper to abut against the rear duplex 76 is present, none of the settings is to be changed in response to the operation of releasing the key.

Next, when an ON operation of a damper pedal is detected, the resonance setter 60 sets the gain values of the level adjustors 318L-1 to 318L-88, 318R-1 to 318R-88 of all of the pitches to predetermined values (S26), and sets the gain values of the first attenuators 313-1 to 313-88 of all of the pitches to pre-saved predetermined values FBG1 (x) respectively corresponding to respective pitches (S27). These settings are made to simulate the dampers of all of the pitches being released from the strings due to the depression of the damper pedal. As for the second resonance signal generator 320-*n*, none of the settings is to be changed either in this case.

The gain values that are set in the step S26 may also be 1 similarly to the settings made in the step S22, or may be calculated in advance based on the settings of the LR balance and the level of the resonance signal.

Next, when an OFF operation of the damper pedal is detected, the resonance setter 60 sets the gain values of the level adjusters 318L-1 to 318L-88 and 318R-1 to 318R-88 of all of the pitches except for the pitch corresponding to the key being depressed to 0 (S28), and sets the gain values of the first attenuators 313-1 to 313-88 of all of the pitches except for the pitch corresponding to the key being depressed to 0 (S29). These settings are made to simulate the dampers, of all of the pitches except for the pitch corresponding to the key being depressed, abutting against the strings due to the release of the damper pedal. As for the pitch corresponding to the key being depressed, the damper is released from the string regardless of the state of the damper pedal. As for the second resonance signal generator 320-*n*, none of the settings is to be changed either in this case.

The resonance setter 60 performs the above-mentioned processing of FIGS. 6 and 7, so that the resonance signal generating device 20 can generate the resonance signal that simulates the resonance caused by vibration of each string by simulating the operation of an actual piano in response to an operation of the keyboard and the damper pedal of the piano.

In this case, a first resonance signal, which is generated by a first resonance signal generator 310 and corresponds to a speaking length 75, becomes 0 in response to the settings made in the steps S14 and S15 after a key release. In contrast, the attenuation rate of a second resonance signal, which is generated by a second resonance signal generator 320 and corresponds to a rear duplex 76, does not change even after a key release.

Because the level of an excitation signal is lowered by a rear duplex input generator 328, the reverberation caused by this second resonance signal normally stands out less than the reverberation caused by a first resonance signal. However, in the performance such as Staccato in which an operation of releasing a key is performed in a short time after an operation of depressing the key is performed and before the second resonance signal excited by a key depression is not attenuated too much, and then no operation is performed for some time before the next key depression is carried out, the reverberation at a high pitch caused by the second resonance signal stands out during the time from the key release to the next key depression, so that the reverberation at a high pitch to which a front duplex 77 and a rear duplex 76 contribute in an actual piano can be reproduced.

Thus, the resonance signal generating device 20 can generate a sound signal of a resonance sound of a string closer to an actual piano as compared to the case where a second resonance signal generator 320 is not present.

That is, the configuration of the above-mentioned embodiment enables generation of a resonance sound of a string closer to an actual piano or its sound signal when a musical performance sound simulating the piano or its sound signal is generated.

In addition to the above-mentioned processing, it is conceivable that the gain values of the level adjustors 317L, 317R are changed depending on whether the damper pedal is in an ON state. For example, the gain values of the level adjustors 317L-1 to 317L-88, 317R-1 to 317R-88 of all of the pitches are set to first setting values in response to a trigger caused by a damper pedal ON state, or the gain values of the level adjustors 317L-1 to 317L-88, 317R-1 to 317R-88 of all of the pitches are set to second setting values in response to a trigger caused by a damper pedal OFF state. The same also applies to the gain values of the level adjustors 327L, 327R.

While the foregoing description of the embodiment is completed, the configuration of the device, the specific contents and procedures of processing and calculation, the number of resonance signal generators and so on, as a matter of course, are not limited to the description made in above-mentioned embodiment.

The 88 resonance signal generators 30 corresponding to the piano having 88 strings are provided in the above-mentioned embodiment, by way of example. However, the number of the resonance signal generators 30 can be any number. Even when the tone color of a piano is to be simulated, it is not essential to provide the resonance signal generators 30 corresponding to all strings. When a piano other than the piano having 88 keys is simulated, the number of resonance signal generators 30 to be provided corresponds to the number of keys included in the piano.

Further, a plurality of strings having slightly different resonance frequencies may be provided in a piano for one pitch. Accordingly, it is conceivable that a plurality of resonance signal generators 30 that generate resonance signals of the resonance frequencies respectively corresponding to the strings are provided for one pitch.

Further, pitches to be used are not limited to be in accordance with equal temperament.

While the sets of the first resonance signal generator 310 and the second resonance signal generator 320 are provided in the resonance signal generators 30 corresponding to all of the pitches in the above-mentioned embodiment, it is not essential. Sets of the first resonance signal generator 310 and the second resonance signal generator 320 may be provided only for part of the pitches, and only first resonance signal generators 310 may be provided for the other pitches.

Figure 8:
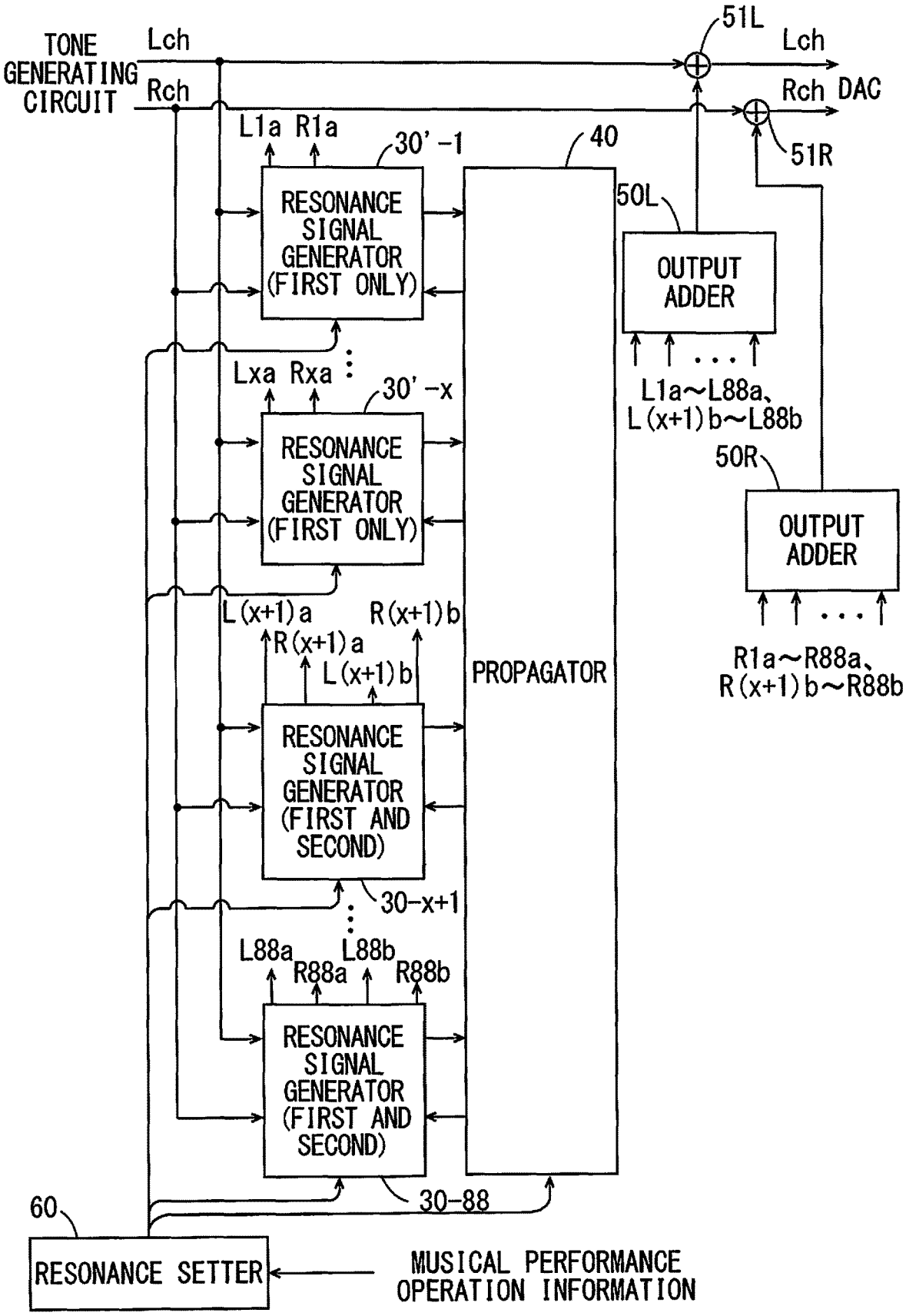
FIG. 8, corresponding to FIG. 2, is a diagram showing the configuration of a modified example.

FIG. 8 shows the example of such a configuration. FIG. 8, corresponding to FIG. 2, shows the functional configuration of a resonance signal generating device 20 in which sets of a first resonance signal generator 310 and a second resonance signal generator 320 are provided in a resonance signal generator 30 for each of the pitches from the (x+1)th to 88th pitches in a higher range, and a second resonance signal generator 320 is not provided and only a first resonance signal generator 310 is provided in a resonance signal generator 30' for each of the pitches from the 1st to x-th pitches in a lower range (x is equal to or higher than 1.) When a second resonance signal generator 320 is not provided, an adder 315 is not required.

Since certain resources are required for provision of the second resonance signal generators 320, the second resonance signal generators 320 may be provided limitedly for the range of the pitches corresponding to more important second resonance signals. In this case, resources can be saved. Here, the resources include a mounting area, the number of components and the like for circuits, and include processing capability of a processor for software.

Depending on the model of a piano, vibration suppression members such as felt members may be pressed against rear duplexes 76 of the pitches in a lower range to mute the rear duplexes 76. When simulating the piano of such a model, second resonance signal generators 320 are not required for the pitches in the above-mentioned lower range. However, the approach for using the second resonance signal generators 320 can be employed to simulate front duplexes 77.

Further, the function of the unused second resonance signal generators 320 may be disabled substantively by setting the gain values of the second attenuators 323 and the level adjustors 341L, 341R to 0 such that the model having a mute function and the model not having the mute function can be selectively simulated.

While the first resonance signal generator 310 and the second resonance signal generator 320 are provided for each of a predetermined number of different pitches from the highest sound and only the first resonance signal generator 310 is provided for each of one or more pitches from the lowest sound in the example of FIG. 8, the first resonance signal generator 310 and the second resonance signal generator 320 may be provided for each of a predetermined number of pitches in any higher range and only the first resonance signal generator 310 may be provided for each of one or more pitches in any lower range.

Further, in addition to the above-mentioned modification, a low-pass filter for simulating the change in vibration caused by characteristics of a soundboard and a bridge may be provided to follow the final adder 412-88 in the propagator 40.

Further, it is conceivable that a plurality of second resonance signal generators 320 are provided in parallel to one resonance signal generator 30.

Figure 9:
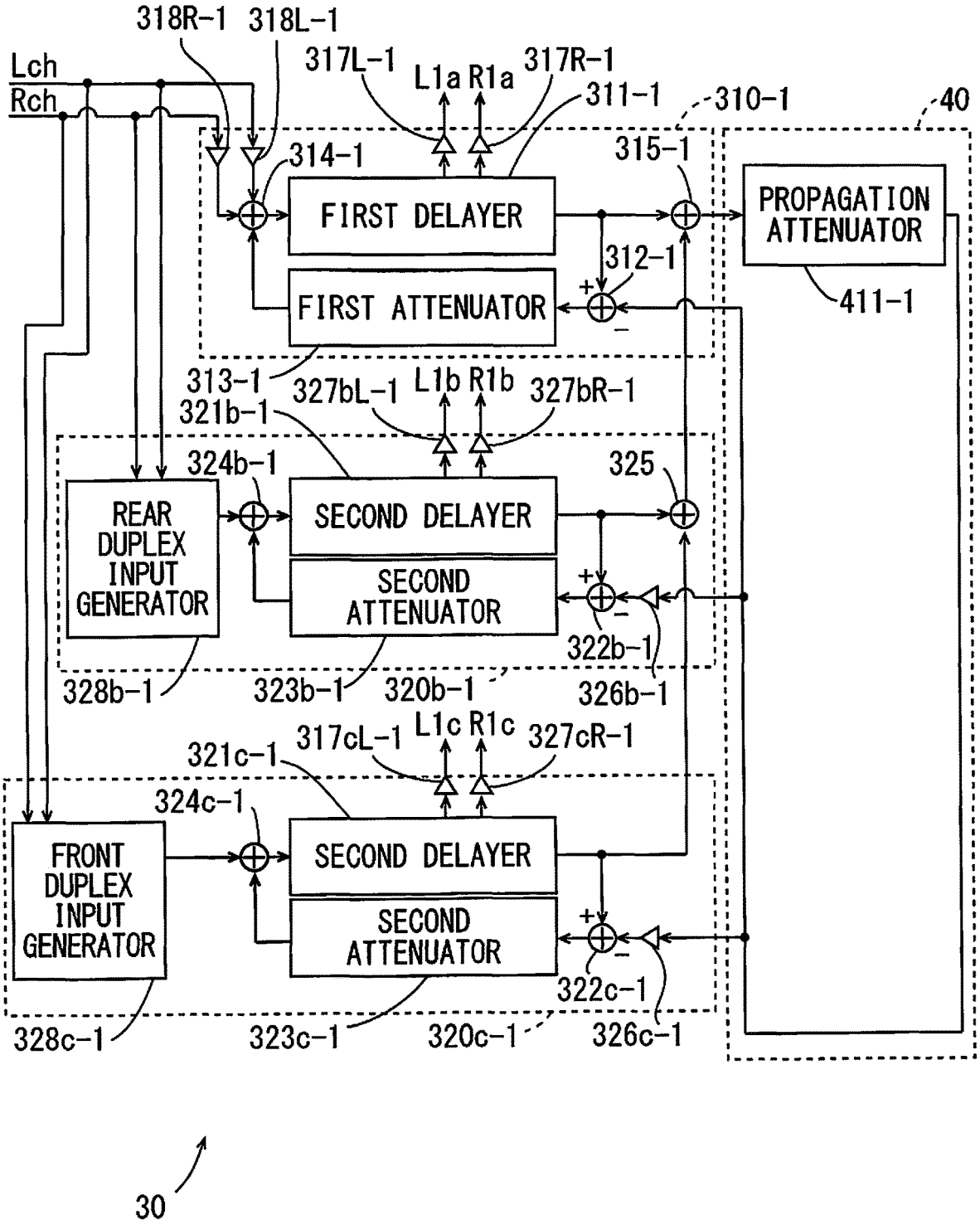
FIG. 9 is a diagram showing the functional configuration of a resonance signal generator and a propagator corresponding to one pitch in another modified example.

FIG. 9 shows the configurations of a resonance signal generator 30 and a propagator 40 in the case where two second resonance signal generators 320 are provided. FIG. 9 shows only a resonance signal generator 30 corresponding to one pitch.

In the configuration of FIG. 9, a second resonance signal generator 320*b* and a second resonance signal generator 320*c* are provided in the resonance signal generator 30. While the second resonance signal generator 320*b* and the second resonance signal generator 320*c* basically have the same configuration, it is conceivable that the second resonance signal generator 320*b* is used to simulate the resonance of a rear duplex 76, and the second resonance signal generator 320*c* is used to simulate the resonance of a front duplex 77.

In this case, delay amounts are set in second delayers 321*b*, 321*c* to respectively correspond to the resonance frequencies of strings, and the gain values are also set in second attenuators 323*b*, 323*c* to respectively correspond to the characteristics of strings. While a front duplex input generator 328*c* has the configuration shown in FIG. 5 and similar to that of a rear duplex input generator 328*b*, the gain values of the level adjustors 341L, 341R and the envelope to be used by the envelope controller 434 are set to be suitable for the arrangement and characteristics of the front duplex 77.

The level of a resonance signal held by the second delayer 321*b* is adjusted by level adjustors 327*b*L, 327*b*R respectively, and the level of a resonance signal held by the second delayer 321*c* is adjusted by level adjustors 327*c*L, 327*c*R respectively. The resonance signals are input to the output adders 50L, 50R of FIG. 2 as the resonance signals of L and R channels that are output by the second resonance signal generators 320*b*, 320*c*.

Further, the second resonance signal generator 320*b* and the second resonance signal generator 320*c* include level adjustors 326*b*, 326*c* in addition to the configuration of the second resonance signal generator 320 shown in FIG. 3. The level adjustors 326*b*, 326*c* are provided to simulate the rear duplex 76 and the front duplex 77 that are influenced differently from each other by a bridge 72 that is simulated by the propagator 40. As can be taken from FIG. 4, while the rear duplex 76 and the bridge 72 are in contact with each other, the front duplex 77 and the bridge 72 are not in contact with each other. Therefore, it is considered that the front duplex 77 receives small propagation of vibration energy from the bridge 72. Thus, it is possible to simulate this difference by setting a gain close to 1 for the level adjustor 326*b* and setting a gain close to 0 for the level adjustor 326*c*.

Further, it is considered that propagation of vibration energy from the rear duplex 76 to the bridge 72 and propagation of vibration energy from the front duplex 77 to the bridge 72 may be different from each other by a similar difference. As such, it is conceivable to simulate this difference by providing a signal output path from the second delayer 321*b* to an adder 325 and a signal output path from the second delayer 321*c* to the adder 325 with level adjustors respectively and setting a gain close to 1 for the level adjustors at the signal output paths while setting a gain close to 0 for the level adjustor 326*c*.

The above-mentioned configuration enables generation of the sound signal of the resonance sound of the string closer to the actual piano as compared to the simulation of the resonance of the rear duplex 76 and the front duplex 77 in the second resonance signal generator 320 having one loop as described in the above-mentioned embodiment.

Further, the propagator 40 is not essential in the present invention. It is possible to achieve some functions without provision of the propagator 40 by setting necessary parameter values for the second resonance signal generator 320, generating the second excitation signal, the level of which corresponds to the propagation of vibration through the bridge, in the rear duplex input generator 328 in order to obtain only the resonance signal simulating the resonance of the rear duplex 76 or the front duplex 77.

In addition, the resonance signal generated in the second resonance signal generator 320 does not necessarily simulate the same string as the string simulated by the corresponding first resonance signal generator 310. Depending on the model of a piano, another string for generation of a resonance sound that is not to be hit in response to a key depression may be provided separately from the speaking length, for example. The pitch having the resonance frequency of the string for generation of a resonance sound may be lower or higher than the sound range of the speaking length, or can also be in the sound range of the speaking length. It is conceivable that the second resonance signal generator 320 is used to simulate such resonance of the string for generation of a resonance sound. In consideration of such a case, the pitch of the resonance signal generated by the second resonance signal generator 320 may be lower than the pitch of the resonance signal generated by the corresponding first resonance signal generator 310.

Further, in the above-mentioned embodiment, the resonance signal generating device 20 is configured as a unit incorporated in the electronic musical instrument 10, by way of example. However, the resonance signal generating device 20 can be configured as an independent device including the function of generating a resonance signal indicating a resonance sound of a string excited by an input sound signal based on the sound signal, for example. In this case, the resonance signal generating device 20 can be configured to control each component shown in FIGS. 2 and 3 by a computer constituted by a CPU, a ROM, a RAM and so on. Alternatively, the resonance signal generating device 20 can be configured to realize the function of each component shown in FIGS. 2 and 3 by allowing a computer to execute a necessary program. The program, in this case, is an embodiment of the present invention.

Such a program may be stored in a ROM or another non-volatile recording medium (a flash memory, an EEPROM or the like) originally included in the computer. However, the program can be recorded in any non-volatile recording medium such as a memory card, a CD, a DVD or a blue-ray disc to be provided. It is possible to realize each above-mentioned function by installing the program recorded in each of these recording media in the computer and executing the program.

Further, it is also possible to download the program from an external device that is connected to a network and includes a recording medium recording the program or an external device having a storage storing the program, install the program in the computer and execute the program.

Further, in addition to being configured as the electronic musical instrument 10, the electronic musical apparatus of the present invention can also be configured as a tone generation device that does not include a musical performance operating element 17 but generates sound data of a musical piece in accordance with musical performance data that is supplied externally. Further, the method of generating sound data is not limited to the PCM method, and any method such as an FM (Frequency Modulation Method) can be employed.

While the sound signal generated by the tone generating circuit 18 is used as a first excitation signal without modification in the above-mentioned embodiment, by way of example, the signal that is acquired by a process such as extraction of an attack portion similar to the process performed for generation of a second excitation signal may be used as a first excitation signal. Alternatively, if the resources allow, a sound signal of a musical sound and a sound signal for excitation may be generated separately as sound signals having different tone colors based on one musical performance operation, and the latter may be used as a first excitation signal and a second excitation signal. Further, if the resources allow, first and second excitation signals may be generated separately as sound signals of different tone colors.

Further, unlike the configuration in which the sound signal of the resonance sound is added to the sound signal received externally as described in the above-mentioned embodiment, the resonance signal generating device 20 can be configured to use a signal indicating the energy of hit of a string as an excitation signal, and may be configured to generate both of the signal of a string hit sound and the signal of the resonance sound generated from the string in response to hit of the string by each resonance signal generator 30. In this case, the tone generation circuit 18 that is generated with use of a tone color of a piano, for example, can generate an excitation signal to be input to each resonance signal generator 30 by extracting a signal that is generated in an extremely short period of time from the time of hit of the string from a sound signal. Further, since the excitation signal indicates the energy of hit of the string in this case, the excitation signal is not input to resonance signal generators 30 corresponding to all of the pitches as described in the above-mentioned embodiment, but is input only to the resonance signal generator 30 of the pitch corresponding to the key that has been depressed.

Further, the functions of each device described above can be distributively provided in a plurality of devices, and the functions similar to the functions of each above-mentioned device can be realized by cooperation of the plurality of devices.

Further, as a matter of course, the configurations of each embodiment and the modified example that have been described above can be implemented in combination with one another to the extent not inconsistent with one another.

As being apparent from the above-mentioned description, the present invention enables generation of a resonance sound of a string closer to an actual piano or its sound signal when the musical performance sound simulating the piano or its sound signal is generated. Thus, a device that outputs the sound close to the actual piano or its sound signal can be provided.

We claim:

1. A resonance signal generating method comprising:

generating a first resonance signal of a first pitch circulating through first loop processing by inputting a first excitation signal to the first loop processing including first delay that delays the signal by a time corresponding to the first pitch and first attenuation that attenuates the signal, the first pitch being a pitch having a resonance frequency of a predetermined speaking length of a piano;

generating a second resonance signal of a second pitch circulating through second loop processing by inputting a second excitation signal to the second loop processing including second delay that delays the signal by a time corresponding to the second pitch and second attenuation that attenuates the signal, the second pitch not being a pitch having a resonance frequency of any of speaking lengths of the piano or a pitch of a harmonic thereof but being higher than the first pitch; and outputting the first resonance signal circulating through the first loop processing and the second resonance signal circulating through the second loop processing.

2. The resonance signal generating method according to claim 1, wherein the generating the first resonance signal includes generating the first resonance signal circulating through the first loop processing by adding the signal attenuated by the first attenuation and the input first excitation signal to each other, delaying the added signal by the first delay and attenuating the signal delayed by the first delay by the first attenuation, and the generating the second resonance signal includes generating the second resonance signal circulating through the second loop processing by adding the signal attenuated by the second attenuation and the input second excitation signal to each other, delaying the added signal by the second delay and attenuating the signal delayed by the second delay by the second attenuation.

3. The resonance signal generating method according to claim 1, wherein the first and second excitation signals are sound signals that are generated based on a common musical performance operation.

4. The resonance signal generating method according to claim 1, further comprising adding the first and second resonance signals to each other and attenuating the added first and second resonance signals, and inputting the signals acquired by addition and attenuation to the first and second loop processing.

5. The resonance signal generating method according to claim 1, wherein the generating the first and second resonance signals includes performing a plurality of sets of the first and second loop processing respectively corresponding to a plurality of speaking lengths of the piano, and a second pitch in second loop processing in each set is not a pitch having a resonance frequency of any of speaking lengths of the piano or a pitch of a harmonic thereof.

6. The resonance signal generating method according to claim 1, wherein the generating the first and second resonance signals includes performing a plurality of sets of the first and second loop processing respectively corresponding to a predetermined number of speaking lengths of pitches in a higher range of the piano, performing the first loop processing corresponding to each speaking length of a lower pitch than the pitches of the predetermined number of speaking lengths, and not performing the second loop processing corresponding to the speaking length of the lower pitch or disabling the second loop processing corresponding to the speaking length of the lower pitch.

7. The resonance signal generating method according to claim 1, wherein the second excitation signal is a same signal as the first excitation signal or is a signal generated by a process of the first excitation signal.

8. The resonance signal generating method according to claim 7, wherein the second excitation signal is a signal acquired by enhancement of an attack of the first excitation signal.

9. The resonance signal generating method according to claim 1, wherein the second pitch is a pitch having a resonance frequency of a front duplex or a rear duplex corresponding to the predetermined speaking length of the piano.

10. The resonance signal generating method according to claim 1, further including:

generating a sound signal indicating a musical performance sound of a predetermined tone color in response to a detected musical performance operation; and supplying the generated sound signal to the first loop processing as the first excitation signal and supplying the generated sound signal without modification or a signal acquired by a process of the generated sound signal to the second loop processing as the second excitation signal, wherein the outputting the first and second resonance signals includes adding the generated sound signal and the first and second resonance signals to one another and outputting a signal acquired by addition.

11. A resonance signal generating device comprising:

a first resonance signal generator that includes a first loop including a first delayer that delays a signal by a time corresponding to a first pitch and a first attenuator that attenuates the signal, and a first excitation inputter that inputs a first excitation signal to the first loop, the first pitch being a pitch having a resonance frequency of a predetermined speaking length of a piano;

a second resonance signal generator that includes a second loop including a second delayer that delays the signal by a time corresponding to a second pitch and a second attenuator that attenuates the signal, and a second excitation inputter that inputs a second excitation signal to the second loop, the second pitch not being a pitch having a resonance frequency of any of speaking lengths of the piano or a pitch of a harmonic thereof but being higher than the first pitch; and an outputter that outputs a first resonance signal circulating through the first loop and a second resonance signal circulating through the second loop.

12. The resonance signal generating device according to claim 11, wherein the first resonance signal generator generates the first resonance signal circulating through the first loop by adding the signal attenuated by the first attenuator and the input first excitation signal to each other, delaying the added signal by the first delayer and attenuating the signal delayed by the first delayer by the first attenuator, and the second resonance signal generator generates the second resonance signal circulating through the second loop by adding the signal attenuated by the second attenuator and the input second excitation signal to each other, delaying the added signal by the second delayer and attenuating the signal delayed by the second delayer by the second attenuator.

13. The resonance signal generating device according to claim 11, wherein the first and second excitation signals are sound signals that are generated based on a common musical performance operation.

14. The resonance signal generating device according to claim 11, further comprising an attenuation inputter that adds the first and second resonance signals to each other and attenuates the added first and second resonance signals, and inputs the signals acquired by addition and attenuation to the first and second loops.

15. The resonance signal generating device according to claim 11, wherein the first and second resonance signal generators include a plurality of sets of the first and second resonance signal generators respectively corresponding to a plurality of speaking lengths of the piano, and a second pitch in the second loop of the second resonance signal generator of each set is not a pitch having a resonance frequency of any of the speaking lengths of the piano or a pitch of a harmonic thereof.

16. The resonance signal generating device according to claim 11, wherein the first and second resonance signal generators include a plurality of sets of the first and second resonance signal generators respectively corresponding to a predetermined number of speaking lengths of pitches in a higher range of the piano, include a first resonance signal generator corresponding to each speaking length of a lower pitch than the pitches of the predetermined number of speaking lengths, and do not include a second resonance signal generator corresponding to each speaking length of the lower pitch or disable the second loop of the second resonance signal generator corresponding to each speaking length of the lower pitch.

17. The resonance signal generating device according to claim 11, wherein the second pitch is a pitch having a resonance frequency of a front duplex or a rear duplex corresponding to the predetermined speaking length of the piano.

18. The resonance signal generating device according to claim 11, further comprising a sound signal generator that generates a sound signal indicating a musical performance sound of a predetermined tone color in response to a detected musical performance operation, wherein the first resonance signal generator supplies the sound signal generated by the sound signal generator to the first loop as the first excitation signal, the second resonance signal generator supplies the sound signal without modification generated by the sound signal generator or a signal acquired by a process of the generated sound signal to the second loop as the second excitation signal, and the outputter adds the sound signal generated by the sound signal generator and the first and the second resonance signals to one another and outputs a signal acquired by addition.

19. An electronic musical apparatus comprising:

the resonance signal generating device according to claim 11;

a sound signal generator that generates a sound signal indicating a musical performance sound of a predetermined tone color in response to a detected musical performance operation;

a supplier that supplies the sound signal generated by the sound signal generator to the first loop of the resonance signal generating device as the first excitation signal and supplies the generated sound signal without modification or a signal acquired by a process of the generated sound signal to the second loop of the resonance signal generating device as the second excitation signal; and a sound signal outputter that adds the sound signal generated by the sound signal generator and a sound signal output from an outputter of the resonance signal generating device to each other and outputs a sound signal acquired by addition.

20. A non-transitory computer readable medium storing a program allowing a computer to:

generate a first resonance signal of a first pitch circulating through first loop processing by inputting a first excitation signal to the first loop processing including first delay that delays the signal by a time corresponding to the first pitch and first attenuation that attenuates the signal, the first pitch being a pitch having a resonance frequency of a predetermined speaking length of a piano;

generate a second resonance signal of a second pitch circulating through second loop processing by inputting a second excitation signal to the second loop processing including second delay that delays the signal by a time corresponding to the second pitch and second attenuation that attenuates the signal, the second pitch not being a pitch having a resonance frequency of any of speaking lengths of the piano or a pitch of a harmonic thereof but being higher than the first pitch; and output the first resonance signal circulating through the first loop and the second resonance signal circulating through the second loop.

* * * * *